US005471697A

United States Patent [19]

Daconta

[11] Patent Number: 5,471,697

[45] Date of Patent: Dec. 5, 1995

[54] DISPOSABLE DISINTEGRATING CLEANING DEVICE

[76] Inventor: Frank J. Daconta, 3 Siegfried Pl., East Northport, N.Y. 11731

[21] Appl. No.: 349,327

[22] Filed: Dec. 5, 1994

[51] Int. Cl.[6] ..... A47L 25/00

[52] U.S. Cl. ..... 15/104.94; 15/210.1

[58] Field of Search ..... 15/104.93, 104.94, 15/208, 209.1, 210.1

[56] References Cited

U.S. PATENT DOCUMENTS

| | | | |
|---|---|---|---|
| 2,271,861 | 2/1942 | Harris | 26/210.1 |
| 2,610,347 | 9/1952 | Kleiner | 15/210.1 |
| 2,648,085 | 8/1953 | Rodgers | 15/210.1 |
| 2,666,223 | 1/1954 | Farrell | 15/210.1 |
| 2,668,974 | 2/1954 | Jaeger | 15/210.1 |
| 2,710,982 | 6/1955 | Gillem | 15/210.1 |
| 2,816,312 | 12/1957 | Beck et al. | 15/210.1 |
| 3,188,675 | 6/1965 | Beck | 15/210.1 |
| 3,221,356 | 12/1965 | Schirmer | 15/210.1 |
| 3,356,419 | 12/1967 | Peck | 15/210.1 |
| 3,495,918 | 2/1970 | Leland | 15/210.1 |
| 3,881,210 | 5/1975 | Drach et al. | 15/209.1 |
| 4,362,781 | 12/1982 | Anderson | 15/209.1 |
| 4,493,124 | 1/1985 | Agapiou | 15/104.94 |
| 5,264,269 | 11/1993 | Kakiuchi et al. | 15/209.1 |

FOREIGN PATENT DOCUMENTS

| | | | |
|---|---|---|---|
| 2209366 | 9/1973 | Germany | 15/104.94 |
| 2134775 | 8/1984 | United Kingdom | 15/104.93 |

*Primary Examiner*—Mark Spisich

[57] ABSTRACT

The present invention relates to a cleaning device for cleaning various surfaces, such as the surfaces in and about a toilet, the device comprising a shaft defining a longitudinal axis and having a proximal end and a distal end, the proximal end adapted to be held by a user to manipulate the device; and a water soluble brush releasably fitted on the distal end of the shaft, wherein the brush is configured to dissolve in water. In a preferred embodiment of the device, the shaft is constructed of a water soluble material.

20 Claims, 2 Drawing Sheets

DISPOSABLE DISINTEGRATING CLEANING DEVICE

BACKGROUND OF THE INVENTION

1. Field of the Invention

The present invention relates generally to cleaning devices. More particularly, the present invention relates to a disposable cleaning device which is partially to totally water soluble or disintegratable.

2. Description of the Prior Art

Numerous cleansing apparatuses have been provided in prior art that are adapted to destroy, neutralize and inhibit the growth of harmful microorganisms in toilet bowls and the like. Typically the apparatus is a brush mounted on the distal end of a plastic shaft. However, upon completion of the cleaning of the toilet bowl with the brush, the user has heretofore been confronted with the problems of how to clean the brush; where to clean the brush; where to store the brush; all without the inherent transmission of infectious organisms. A need therefore exists for a cleaning device which eliminates the need for cleaning the device while minimizing storage requirements.

Numerous innovations for toilet brushes have been provided in the prior art that are adapted to be used. Even though these innovations may be suitable for the specific individual purposes to which they address, they would not be suitable for the purposes of the present invention as heretofore described.

SUMMARY OF THE INVENTION

The present invention includes a cleaning device for cleaning various surfaces, such as the surfaces in and about a toilet, the device comprising a shaft defining a longitudinal axis and having a proximal end and a distal end, the proximal end adapted to be held by a user to manipulate the device; and a water soluble brush releasably fitted on the distal end of the shaft, wherein the brush is configured to dissolve or disintegrate in water. In a preferred embodiment of the device, the shaft is constructed of a water soluble material or fiber bonded together by a water soluble binder such as a sugar, starch or other excipient.

Accordingly, it is an object of the present invention to provide a cleaning device which is disposable.

Another object of the invention is to eliminate the need for cleaning the device.

Still another object is to provide a low-cost, light-weight, easy to dispose of device which is self-dissolving in water.

Yet another object of the invention is provide a device which is biodegradable and environmentally safe.

The novel features which are considered characteristic for the invention are set forth in the appended claims. The invention itself, however, both as to its construction and its method of operation, together with additional objects and advantages thereof, will be best understood from the following description of the specific embodiments when read and understood in connection with the accompanying drawing(s).

BRIEF LIST OF REFERENCE NUMERALS UTILIZED IN THE DRAWING

10 - water soluble cleaning device 10
12 - shaft 12
12A - shaft ribs 12A

14 - brush 14
14A- brush bore A
14B - brush head 14B
14C - brush fragments 14C
99 - toilet 99
99A - toilet water 99A

DETAILED LIST OF REFERENCE NUMERALS UTILIZED IN THE DRAWING

10 - water soluble cleaning device 10 comprising: a shaft 12 defining a longitudinal axis and having a proximal end and a distal end, the proximal end adapted to be held by a user to manipulate the device 10; a cleaning or germicidal impregnated brush or head 14 mounted on the distal end of the shaft 12; wherein the device is configured to dissolve or disintegrate in water; to be used once and discarded.

12 - shaft 12 forming a plurality of spaced shaft ribs 12A adjacent the distal end, the shaft fibs 12A adapted to engage an inside surface of the brush 14 to secure the brush 14 to the shaft 12;

12A - shaft ribs 12A disposed axially about the shaft 12;

14 - brush 14 defining a brush bore 14A dimensioned to receive the distal end of the shaft 12 therein, the brush 14 forming a brush head 14B extending substantially perpendicular to the longitudinal axis defined by the shaft 12, the brush 14 adapted to contact a toilet to clean the toilet;

14A - brush bore 14A dimensioned to receive the distal end of the shaft 12 therein;

14B - brush head 14B extending substantially perpendicular to the longitudinal axis defined by the shaft 12;

14C - brush fragments 14C formed subsequent to exposure of the brush 14 to water;

99 - toilet 99 containing toilet water 99A therein; and

99A - toilet water 99A contained within the toilet 99.

DETAILED DESCRIPTION OF THE PREFERRED EMBODIMENT

Figure 2:
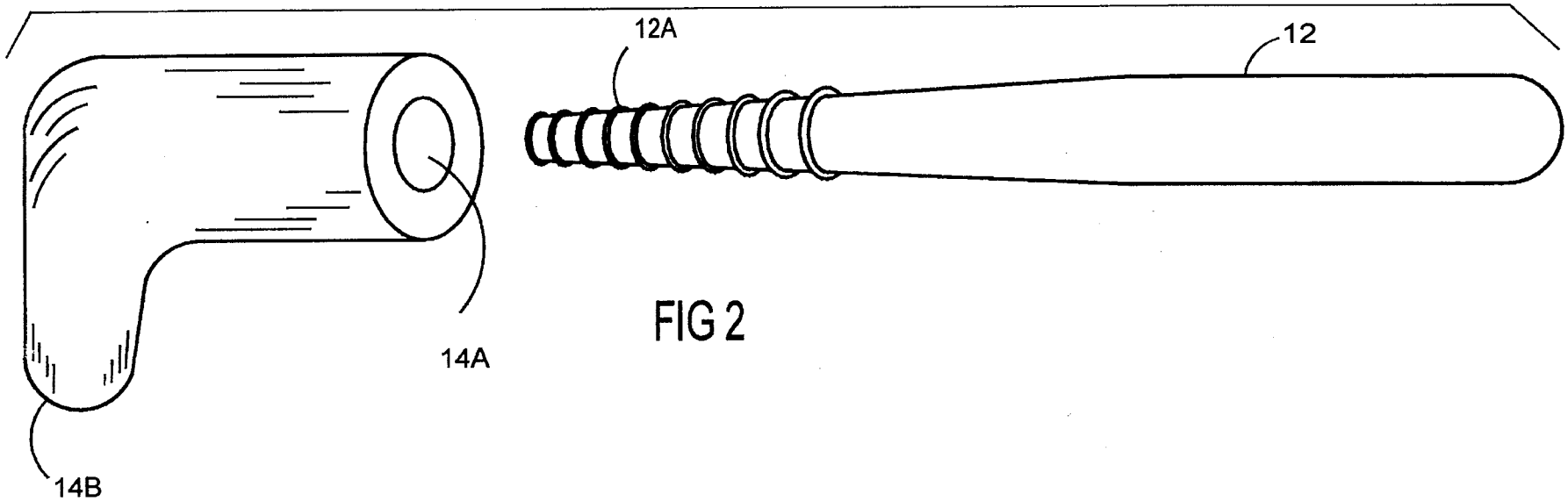
FIG. 2 is a view similar to that of FIG. 1 with parts separated for illustrated purposes.
Figure 1:
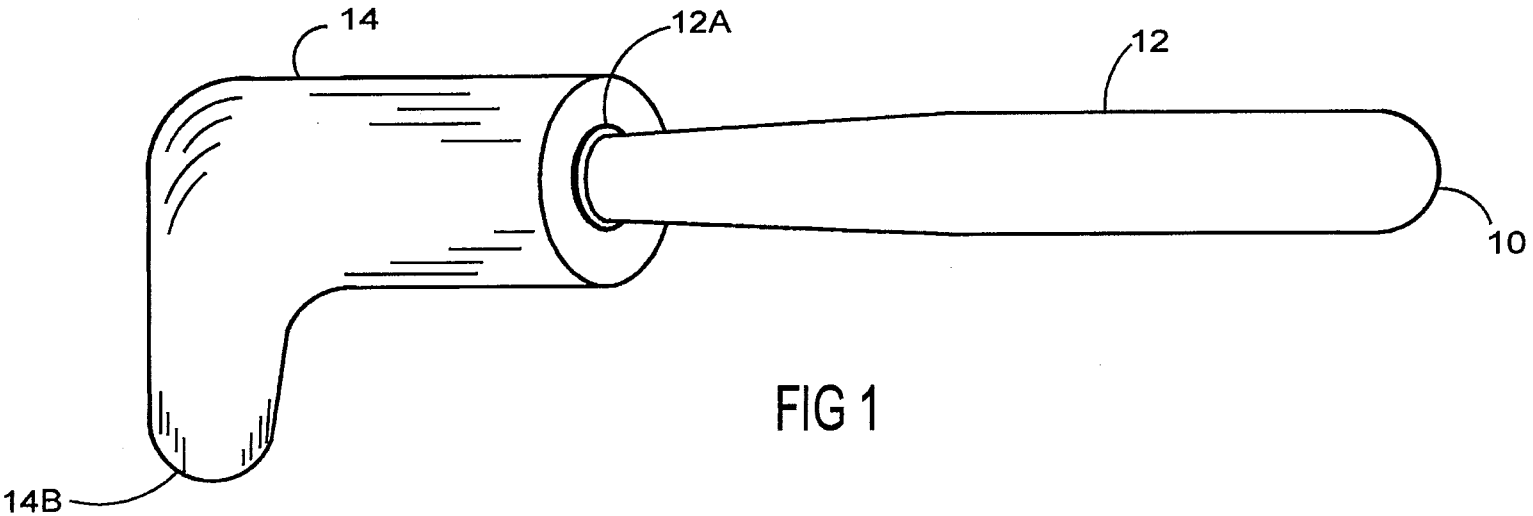
FIG. 1 is an elevational perspective view of a cleaning device constructed in accordance with a preferred embodiment of the present invention.

Firstly, referring to FIGS. 1 and 2 which illustrate a preferred embodiment of the present invention and exhibit the following features: water soluble, disintegratable cleaning device 10 comprising a shaft 12, the shaft 12 defining a longitudinal axis and having a proximal end and a distal end. In this preferred embodiment, the shaft 12 is constructed from a known water soluble biodegradable polymer. Although the shaft 12 is embodied herein as water soluble, it is contemplated that the shaft may be constructed from other nonwater soluble materials, such as, wood fiber, wood or bonded fiber, cardboard, and also other plastics or polymers.

The proximal end of the shaft 12 is of a greater diameter than the distal end of the shaft 12 and is adapted to be held by a user to aid the user in manipulating the device 10. The shaft 12 forms a plurality of spaced shaft ribs 12A adjacent the distal end of the shaft 12, the shaft ribs 12A adapted to engage an inside surface of the brush 14 to secure the brush 14 to the shaft 12. The shaft ribs 12A are disposed axially about the shaft 12 and have diameters which are progressively smaller distal to the proximal end of the shaft 12.

A brush or head 14 is mounted on the distal end of the shaft 12. The brush or head 14 defines a brush bore 14A dimensioned to receive the distal end of the shaft 12 therein and thereby secure the brush or head 14 to the distal end of the shaft 12. The brush or head 14 forms a brush head 14B extending substantially perpendicular to the longitudinal axis defined by the shaft 12 and adapted to contact a toilet to clean the toilet. The brush 14, like the shaft 12, is constructed of a known biodegradable water soluble polymer which dissolves in water. It is contemplated that the brush 14, and or the shaft 12, be coated with a degradable plastic film or water soluble binder or excipient to slow the rate in which the element dissolves when exposed to water. The brush 14 can be manufactured from lignin, photoactive agents, oxidizing agents, enzyme-coated biodegradable polymer particles, vegetable oil, starch, sugar, excipient, acrylic polymers, vinyl polymers, copolymers containing acid groups, sodium propionate or polyethylene glycol. The brush 14 can be impregnated with cleaning agents, distinfecting agents or antimicrobial agents.

Figure 4:
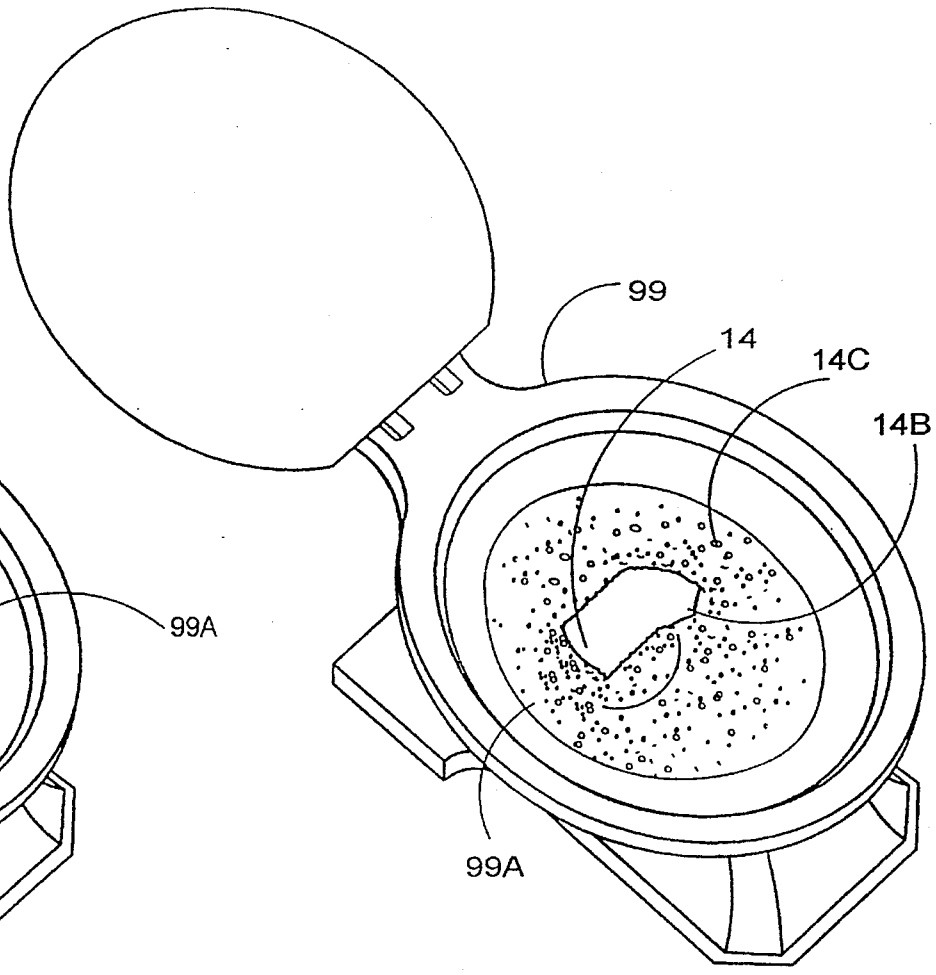
FIG. 4 is a view similar to that of FIG. 3 illustrating the brush portion of the cleaning device having been partially dissolved through exposure to toilet water.
Figure 3:
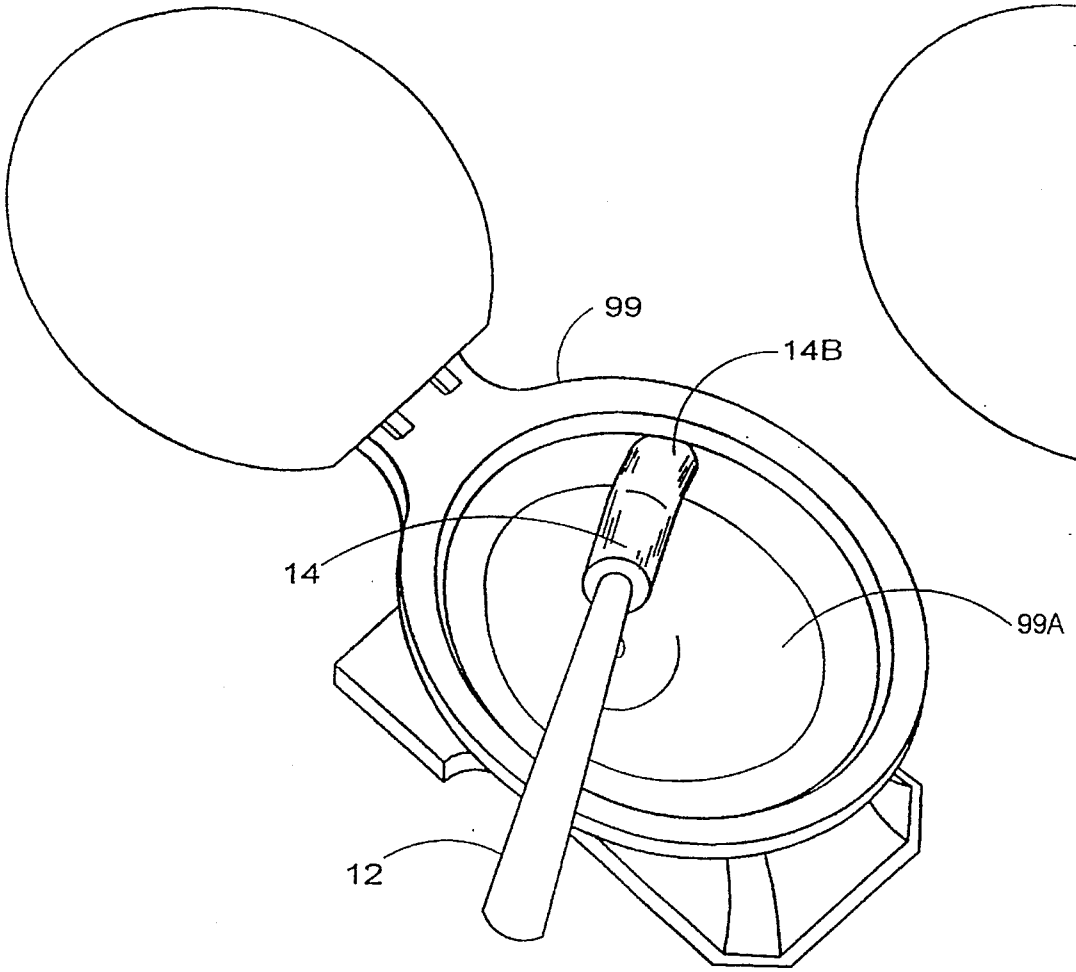
FIG. 3 perspective view of the cleaning device of FIG. 1 disposed within a toilet.

Secondly, referring to FIG. 3 and 4 which illustrate the cleaning device 10 in use within a toilet 99 containing toilet water 99A. As seen in FIG. 3, the brush head 14B is used to clean the surface of the toilet 99 in a conventional manner. Subsequent to the cleaning operation, the cleaning device 10 is left partially submerged in the toilet water 99A in the toilet 99 wherein the cleaning device 10 dissolves over time. Referring to FIG. 4, brush fragments 14C are shown in the toilet water 99A around a partially dissolved brush 14 (the shaft 12 is omitted from this view for illustrative purposes only). As mentioned above, it is contemplated that the shaft and brush head of the cleaning device can be constructed of a material which is not water soluble. In such a case, the the entire cleaning device can be easily and sanitarily discarted. Also only the brush head may be constructed of water soluble or disintegratable material thus the brush will dissolve off of the end of the shaft, the shaft can be rinsed clean, and finally the shaft can be fitted with a replacement bush.

It will be understood that each of the elements described above, or two or more together, may also find a useful application in other types of constructions differing from the type described above.

While the invention has been illustrated and described as embodied in a cleaning device, it is not intended to be limited to the details shown, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A device for cleaning surfaces in and about a toilet, comprising:

a) an elongated shaft having opposite proximal and distal ends which define a longitudinal axis extending therebetween, the proximal end being adapted for manual grasping by a user, the distal end being adapted for mounting thereon a cleaning head, said shaft tapering toward said distal end, the distal end of the shaft further including a plurality of annular ribs extending from a surface thereof in spaced relationship along the axis of the shaft;

b) a cleaning head including a first portion having an elongated bore therein which is adapted to receive the distal end of the shaft, the first portion of the cleaning head being substantially parallel to the axis of the shaft when mounted thereon, the cleaning head further including a second portion disposed at and extending from a distal end of the first portion so as to be substantially perpendicular thereto; and c) the cleaning head being water soluble, and which disintegrates upon being exposed to water in the toilet after cleaning thereof so that the cleaning head may be readily disposed of.

2. The device as defined in claim 1; further comprising a water soluble film coating applied to the exterior of the cleaning head, the coating adapted to decrease the rate in which the cleaning head dissolves when exposed to water.

3. The device as defined in claim 2, wherein the elongated shaft is constructed of a plastic.

4. The device as defined in claim 2, wherein the elongated shaft is constructed of a material selected from the group consisting of wood, wood fiber, bonded fiber, and cardboard.

5. The device as defined in claim 2, wherein the cleaning head is manufactured from a material selected from the group consisting of lignin, photoactive agents, oxidizing agents, enzyme-coated biodegradable polymer particles, vegetable oil, starch, sugar, excipient, acrylic polymers, vinyl polymers, copolymers containing acid groups, sodium propionate, and polyethylene glycol.

6. The device as defined in claim 5, wherein the elongated shaft is constructed of a material selected from the group consisting of wood, wood fiber, bonded fiber, and cardboard.

7. The device as defined in claim 2, wherein the cleaning head is impregnated with a substance selected from the group consisting of cleaning agents, disinfecting agents, and antimicrobial agents.

8. The device as defined in claim 2, wherein the elongated shaft is water soluble and which disintegrates upon being exposed to water in the toilet after cleaning thereof so that the elongated shaft may be readily disposed of.

9. The device as defined in claim 1, wherein the elongated shaft is constructed of a plastic.

10. The device as defined in claim 9, wherein the cleaning head is manufactured from a material selected from the group consisting of lignin, photoactive agents, oxidizing agents, enzyme-coated biodegradable polymer particles, vegetable oil, starch, sugar, excipient, acrylic polymers, vinyl polymers, copolymers containing acid groups, sodium propionate, and polyethylene glycol.

11. The device as defined in claim 9, wherein the cleaning head is impregnated with a substance selected from the group consisting of cleaning agents, disinfecting agents, and antimicrobial agents.

12. The device as defined in claim 1, wherein the elongated shaft is constructed of a material selected from the group consisting of wood, wood fiber, bonded fiber, and cardboard.

13. The device as defined in claim 12, wherein the cleaning head is manufactured from a material selected from the group consisting of lignin, photoactive agents, oxidizing agents, enzyme-coated biodegradable polymer particles, vegetable oil, starch, sugar, excipient, acrylic polymers, vinyl polymers, copolymers containing acid groups, sodium propionate, and polyethylene glycol.

14. The device as defined in claim 12, wherein the cleaning head is impregnated with a substance selected from the group consisting of cleaning agents, disinfecting agents, and antimicrobial agents.

15. The device as defined in claim 1, wherein the cleaning head is manufactured from a material selected from the group consisting of lignin, photoactive agents, oxidizing agents, enzyme-coated biodegradable polymer particles, vegetable oil, starch, sugar, excipient, acrylic polymers, vinyl polymers, copolymers containing acid groups, sodium propionate, and polyethylene glycol.

16. The device as defined in claim 15, wherein the elongated shaft is water soluble and which disintegrates upon being exposed to water in the toilet after cleaning thereof so that the elongated shaft may be readily disposed of.

17. The device as defined in claim 15, wherein the cleaning head is impregnated with a substance selected from the group consisting of cleaning agents, disinfecting agents, and antimicrobial agents.

18. The device as defined in claim 1, wherein the cleaning head is impregnated with a substance selected from the group consisting of cleaning agents, disinfecting agents, and antimicrobial agents.

19. The device as defined in claim 18, wherein the elongated shaft is water soluble and which disintegrates upon being exposed to water in the toilet after cleaning thereof so that the elongated shaft may be readily disposed of.

20. The device as defined in claim 1, wherein the elongated shaft is water soluble and which disintegrates upon being exposed to water in the toilet after cleaning thereof so that the elongated shaft may be readily disposed of.

* * * * *